US005927087A

United States Patent [19]

Ishikawa

[11] Patent Number: 5,927,087

[45] Date of Patent: Jul. 27, 1999

[54] REFRIGERATING CYCLE

[76] Inventor: Atuyumi Ishikawa, 1314-2 Niinocho, Ohta-shi Gunma, Japan

[21] Appl. No.: 08/842,796

[22] Filed: Apr. 16, 1997

Related U.S. Application Data

[63] Continuation-in-part of application No. 08/552,011, Nov. 2, 1995, abandoned.

[30] Foreign Application Priority Data

Nov. 29, 1994 [JP] Japan ..... 6-295320

[51] Int. Cl.[6] ..... F25B 41/00; F25B 39/04

[52] U.S. Cl. ..... 62/174; 62/184; 62/502

[58] Field of Search ..... 62/174, 184, 502, 62/126

[56] References Cited

U.S. PATENT DOCUMENTS

| | | | |
|---|---|---|---|
| 2,277,138 | 3/1942 | Newton . | |
| 3,668,882 | 6/1972 | Sarsten et al. | 62/77 |
| 5,007,247 | 4/1991 | Danig | 62/174 |
| 5,062,275 | 11/1991 | Hirata et al. | 62/502 X |
| 5,140,827 | 8/1992 | Reedy | 62/174 |
| 5,186,012 | 2/1993 | Czachorski et al. | 62/114 |
| 5,353,604 | 10/1994 | Oguni et al. | 62/502 |

FOREIGN PATENT DOCUMENTS

| | | | |
|---|---|---|---|
| 0 586 193 A1 | 3/1994 | European Pat. Off. . | |
| 0 631 095 A2 | 12/1994 | European Pat. Off. . | |
| 54-2561 | 1/1979 | Japan . | |
| 0044151 | 2/1990 | Japan | 62/174 |

*Primary Examiner*—William Wayner
*Attorney, Agent, or Firm*—Darby & Darby

[57] ABSTRACT

In a refrigerating cycle (air conditioner) using mixture refrigerant, a mixing ratio of the refrigerant in a refrigerant circuit is measured by a mixing ratio detector, and a controller receives the detection signal to open a control valve when the mixing ratio of a high boiling-point refrigerant component is low, whereby the high boiling-point refrigerant stocked in a liquid reservoir is returned to the refrigerant circuit. The high boiling-point refrigerant which is supplied from the liquid reservoir through the opening operation of the control valve is supplied from a low pressure side of a compressor into the refrigerant circuit to keep the mixing ratio of the refrigerant circulating in the refrigerant circuit to a predetermined value, thereby preventing abnormal increase of pressure of the refrigerant due to variation of the mixing ratio.

18 Claims, 12 Drawing Sheets

REFRIGERATING CYCLE

CROSS-REFERENCE TO RELATED APPLICATIONS

This is a continuation-in-part of U.S. application Ser. No. 08/552,011, filed Nov. 2, 1995, now abandoned.

BACKGROUND OF THE INVENTION

1. Field of the Invention

The present invention relates to a refrigerating cycle using a mixture refrigerant which is obtained by mixing plural refrigerants having different characteristics.

2. Description of Related Art

In general, a conventional refrigerant circuit of an air conditioner is constructed of a plurality of elements such as a compressor, a condenser, a pressure-reducing device (expansion device), an evaporator and the like, which are connected with each other through a refrigerant tube to form a loop. A gaseous refrigerant of the air conditioner is compressed by the compressor and circulated through the refrigerant circuit. Such gaseous refrigerant thus circulated through the refrigerant circuit is kept to be within a predetermined pressure range. When the gaseous refrigerant is excessively compressed to allow its pressure to go beyond the above predetermined pressure range, the compressor suffers an overload, or the refrigerant circuit is damaged or suffers leakage of the refrigerant around joint portions of the refrigerant circuit. In order to avoid these troubles, various attempts have been hitherto made to prevent the refrigerant from being excessively compressed in the refrigerant circuit.

In the conventional refrigerant circuit, occurrence of excessive pressure of the refrigerant is mostly due to rapid fluctuation in load and an outside air temperature because a flon refrigerant is used in the prior art and it is sensitive to these factors, that is, the factors of inducing the excessive pressure of the refrigerant is mostly based on extrinsic factors. Recently, in order to prevent destruction of a so-called ozone layer, as disclosed in Japanese Patent Laid-Open Patent Application No. Sho-54-2561 for example, there is known an air conditioner using a mixture refrigerant which is prepared from at least two refrigerant components without using any troublesome refrigerant, the refrigerant components being free from chloride and being mixed with each other to provide predetermined refrigerant properties. In this mixture refrigerant, these refrigerant components have different physical characteristics, such as boiling points or condensation pressure. In the air conditioner using such mixture refrigerant, the condensation pressure of the refrigerant in the refrigerant circuit is varied due to change in mixture ratio of the refrigerant components of the mixture refrigerant. Accordingly, in order to keep the air conditioner in a safety condition, it is necessary to keep the mixture ratio of the mixture refrigerant at a fixed value.

SUMMARY OF THE INVENTION

It is an object of the present invention to provide a refrigerating cycle using a mixture refrigerant formed of at least two refrigerant components having different characteristics, in which the mixture refrigerant can be prevented from being abnormally compressed when it circulates through a refrigerant circuit of the refrigerating cycle.

In order to attain the above object, according to a first aspect of the present invention, a refrigerating cycle in which mixture refrigerant consisting of plural refrigerants having different characteristics are circulated and which includes a refrigerant circuit comprising at least a compressor, a condenser, a pressure-reducing device and an evaporator, the mixture refrigerant being circulated through an operation of the compressor, comprises detection means for detecting a physical status of the mixture refrigerant circulating in the refrigerant circuit, stock means, disposed in said refrigerant circuit, for stocking liquefied refrigerant in the refrigerant circuit, refrigerant supply means for supplying the liquefied refrigerant stocked in the stock means to a predetermined place in the refrigerant circuit at which the pressure of the mixture refrigerant circulating in the refrigerant circuit is reduced, flow amount adjusting means for adjusting the amount of the liquefied refrigerant passing through the refrigerant supply means, and control means for controlling the flow amount adjusting means on the basis of the physical status of the mixture refrigerant which is detected by the detection means, wherein the flow amount of the liquefied refrigerant passing through the refrigerant supply means is controlled on the basis of the physical status detected by the detection means so that the physical status of the mixture refrigerant circulating in the refrigerant circuit is converged to a predetermined range.

According to the refrigerating cycle of the first aspect of the present invention, some of plural refrigerants having different characteristics are mainly liquefied and stocked in the stock means in accordance with the physical status of the mixture refrigerant. Accordingly, the liquefied refrigerant stocked in the stock means is returned to a low-pressure portion of the refrigerant circuit in accordance with the physical status of the refrigerant which is detected by the detection means. When the liquefied refrigerant is returned as described above, the detection means detects the physical status of the mixture refrigerant in the refrigerant circuit, and controls the flow amount adjustment means on the basis of the detected physical status. With this operation, the mixture refrigerant circulating in the refrigerant circuit can be converted into a predetermined range, so that the mixture refrigerant circulating in the refrigerant circuit can be prevented from being kept at an abnormally high pressure.

When the mixture refrigerant is formed of at least R-32 (difluoromethane) and R-125 (pentafluoroethane), the pressure in the refrigerant circuit is more liable to be excessively high, and thus the present invention is more effectively applicable.

When expansion means is used for the flow amount adjusting means, the liquefied refrigerant is returned to the refrigerant circuit in such a state that it is liable to be vaporized.

A temperature detector may be used as the detection means if a condensation temperature is detected as the physical quantity of the mixture refrigerant, and thus the construction can be more simplified.

If the gas-liquid separating means is disposed at the suction side of the compressor to perform gas-liquid separation of the liquefied refrigerant supplied from the stock means, liquid compression by the compressor can be prevented.

Further, if the air flow amount of the fan of the condenser is increased on the basis of the condensation temperature and the control by the fan is performed, the physical variation of the refrigerant state under operation of the refrigerating cycle (air conditioner) can be rapidly and surely converged into the predetermined range.

If the physical quantity of the mixture refrigerant which is detected by the detection means is the temperature of the mixture refrigerant which exists in a low pressure state, the physical state of the refrigerant circuit can be most effectively grasped.

If the amount of the liquefied refrigerant flowing in the refrigerant supply means is controlled to increase when the temperature of the low-pressure side of the refrigerant circuit is lower than a predetermined temperature, the abnormal increase of pressure can be suppressed by a simple temperature measurement.

When the variation gradient of the flow amount of the mixture refrigerant flowing in the refrigerant supply means continues to exceed a predetermined value for a predetermined time or more, the refrigerant may leak from the refrigerant circuit. In this case, the protecting means performs its protection operation for safety to thereby perform a safety operation. As the protection operation, the driving of the compressor may be stopped for safety. The protecting means may be achieved by increasing the amount of the liquefied refrigerant flowing in the refrigerant supply means.

According to a second aspect of the present invention, a refrigerating cycle in which mixture refrigerant consisting of plural refrigerants having different characteristics as compositions are circulated and which includes a refrigerant circuit comprising at least a compressor, a condenser, a pressure-reducing device and an evaporator, the mixture refrigerant being circulated through an operation of the compressor, comprises detection means for detecting a physical status of the mixture refrigerant circulating in the refrigerant circuit, stock means, disposed in the refrigerant circuit, for stocking liquefied refrigerant which is changed from the mixture refrigerant to a liquid phase in the refrigerant circuit, refrigerant recirculating means for recirculating a liquefied refrigerant stocked in the stock means into the refrigerant circuit, and control means for controlling the refrigerant recirculating means on the basis of the physical status of the mixture refrigerant which is detected by the detection means, wherein the recirculation of the liquefied refrigerant into the refrigerant circuit is controlled on the basis of the physical status detected by the detection means so that the physical status of the mixture refrigerant circulating in the refrigerant circuit is converged to a predetermined range.

According to the refrigerating cycle of the second aspect of the present invention, in accordance with the physical state of the mixture refrigerant detected by the detection means, the liquefied refrigerant stocked in the stock means is returned to any place in the refrigerant circuit and recirculated therein irrespective of a low-pressure place or high-pressure place. When the liquefied refrigerant is returned as described above, the detection means detects the physical status of the mixture refrigerant in the refrigerant circuit, and returns the refrigerant on the basis of the detected physical status, whereby the mixture refrigerant circulating in the refrigerant circuit can be converged into the predetermined range. Therefore, the mixture refrigerant circulating in the refrigerant circuit can be prevented from increasing abnormally.

When the mixture refrigerant is formed of at least R-32 (difluoromethane) and R-125 (pentafluoroethane), the pressure in the refrigerant circuit is more liable to be excessively high, and thus the present invention is more effectively applicable.

If the refrigerant recirculating means is designed to guide the liquefied refrigerant stocked in the stock means to the necked portion (diameter-reduced portion) of the gas-liquid separating means, the pressure of the refrigerant at the necked portion is reduced, so that the refrigerant stocked in the liquid reservoir can be surely returned to the refrigerant circuit with no driving force. In addition, if the pressure-reducing portion is designed to have a smaller diameter, the construction can be more simplified.

DETAILED DESCRIPTION OF THE PREFERRED EMBODIMENTS

Preferred embodiments of the present invention will be hereunder described in detail with reference to the accompanying drawings.

Figure 12:
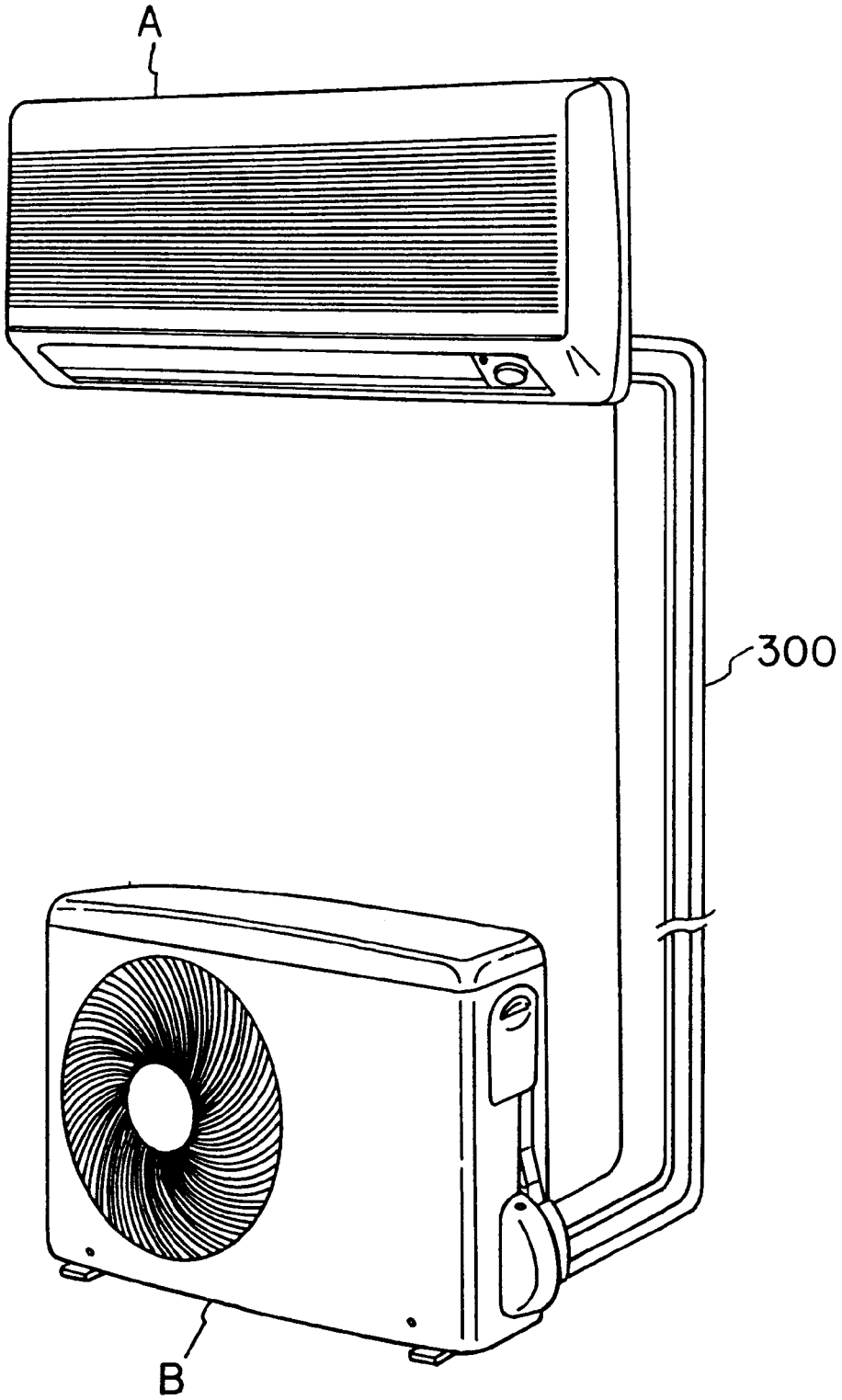
FIG. 12 is a perspective view of the air conditioner of the embodiment of the present invention.

FIG. 12 is a perspective view of a domestic air conditioner using a refrigerating cycle according to an embodiment of the present invention. This type of air conditioner comprises an user side unit "A" disposed inside a room (i.e., indoor unit "A") and a heat-source side unit "B" disposed outside the room (i.e., outdoor unit "B"), which are connected to each other through a refrigerant tube 300.

Figure 1:
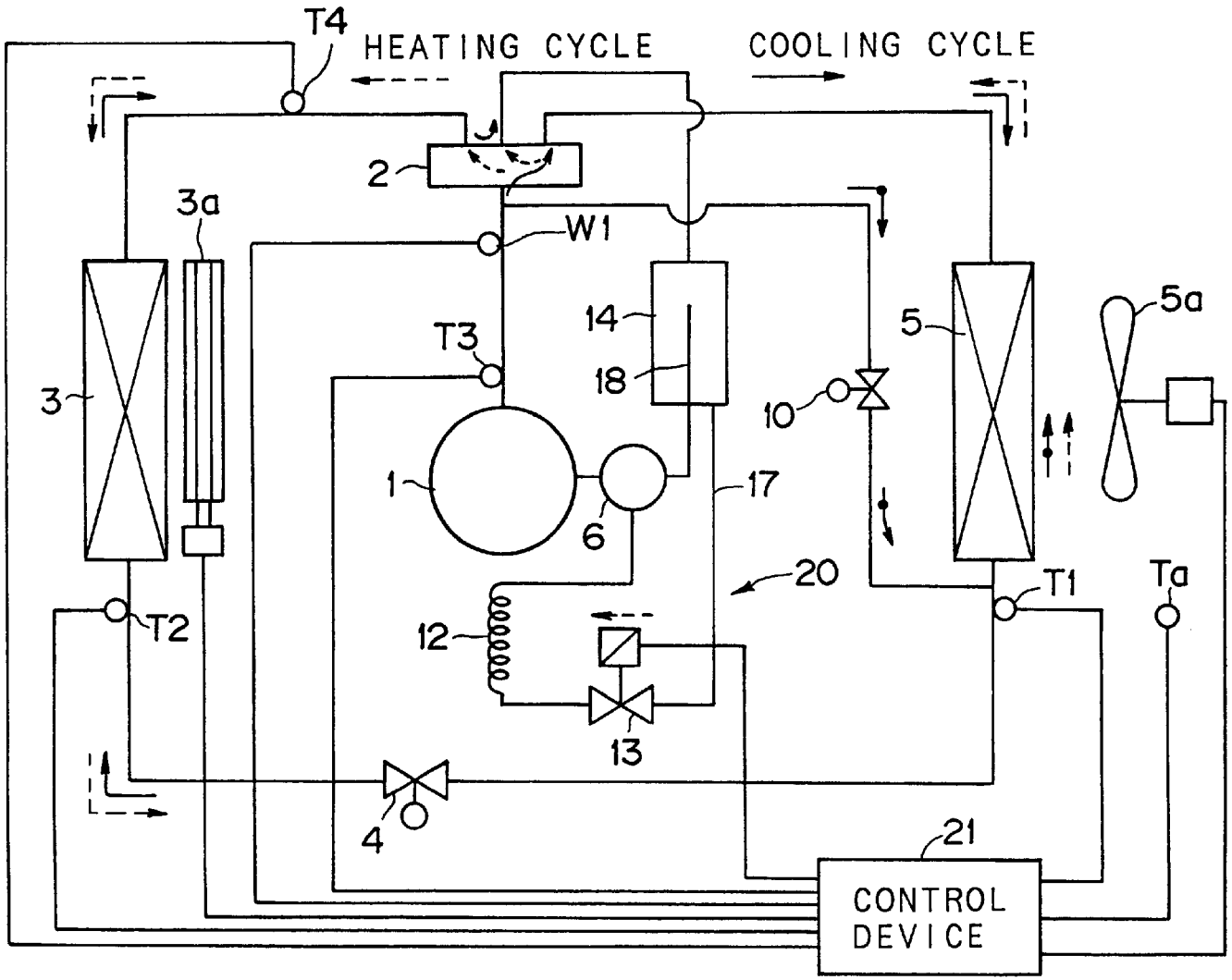
FIG. 1 is a refrigerant circuit diagram of an air conditioner of an embodiment of the present invention (refrigerating cycle)

FIG. 1 is a refrigerant circuit diagram of an air conditioner according to a first embodiment of the present invention. A mixture refrigerant circulating through the refrigerant circuit will be first described prior to description of the refrigerant circuit itself.

As a refrigerant is used a mixture refrigerant containing at least refrigerant components which are different in characteristic such as boiling point, condensation pressure or the like. In other words, the mixture refrigerant may be of two-component system, three-component system or four-component system.

As a mixture refrigerant of three-component system is used R-407 which is formed by mixing 52 wt. % of R-134a (tetrafluoroethane), 25 wt. % of R-125 (pentafluoroethane) and 23 wt. % of R-32 (difluoroethane). In general, the boiling point of R134a is equal to −26° C., that of R-125 is equal to −48° C. and that of R-32 is equal to −52° C. In this mixing ratio, the boiling point and condensation pressure of the mixture refrigerant are kept to −43.9° C. and 18.66 bars, respectively. In the thus-prepared mixture refrigerant, R-32 and R-125 which are lower in boiling point than R-34a are readily evaporated at a room temperature, and thus R-134a tends to remain in liquid phase. When a specified one (R-134a) of the refrigerant components in the mixture refrigerant remains in liquid phase in the refrigerant circuit, the mixing ratio of the mixture refrigerant circulating in the refrigerant circuit varies considerably, so that it is difficult for the refrigerating cycle to sufficiently achieve its initially expected refrigerating effect.

Particularly, when the content of the R-134a (i.e., the refrigerant component having high boiling point) in the refrigerant circuit decreases, the gas pressure of the low boiling refrigerant components increases in the refrigerant circuit, so that an excessive pressure may occur in the refrigerant circuit.

In case of the mixture refrigerant of two-component system, As the mixture refrigerant is used R-410A or R-410B. R410A is formed by mixing 50 wt. %; of R-32 and 50 wt. % of R-125, and it has a boiling point of −52.2° C., a dew point of −52.2° C. and a condensation pressure of 27.30 bars. R-410B is formed by mixing 45 wt. % of R-32 and 55 wt. % of R-125, and it has the similar characteristic to R-410A.

Now, comparing the mixture refrigerant having the above composition with a conventional single refrigerant such as HCFC-22 under predetermined conditions, the following result was obtained: the discharge temperature of the compressor under a specified condition was equal to 66° C. for HCFC-22 and to 73.6° C. for R-40A; the condensation pressure was equal to 7.35 bars for HCFC22 and to 27.30 bars for R-40A; and, the evaporation pressure is equal to 6.76 bars for HCFC-22 and to 0.86 bars for R-40A. Consequently, through the entire refrigerant circuit, the mixture refrigerant (i.e., R-40A) is higher in both temperature and pressure than the conventional single refrigerant (i.e., HCFC-22). Furthermore, in a case where a mixture refrigerant containing R-40A and R-40B is used, the refrigerant composition of the mixture refrigerant little vary because there is substantially no difference in boiling point between these refrigerant components of the mixture refrigerant, so that it is unnecessary to consider a problem which would be caused by temperature glide due to variation in composition of the refrigerant.

Next, the refrigerant circuit of the air conditioner shown in FIG. 1 will be described.

The refrigerant circuit of the air conditioner shown in FIG. 1 includes a compressor, a four-way valve 2, an indoor heat exchanger 3, an expansion device (electromagnetic valve) as a pressure-reducing device 4, an outdoor heat exchanger 5, and an accumulator 6, which are connected to one another through a refrigerant tube.

In accordance with a switching position of the four-way valve and an opening/closing operation of the electromagnetic valve 4, the direction of flow of the refrigerant which is discharged from the compressor 1 into the refrigerating circuit is selectively determined as indicated by one of an arrow of solid line (cooling cycle), an arrow of dotted line (heating cycle) and an arrow with a black dot (defrosting cycle). In the cooling cycle, the heat exchanger 5 disposed at the outdoor side of the circuit serves as a condenser while the heat exchanger 3 at the indoor side of the circuit serves as an evaporator. In the heating cycle, the indoor heat exchanger 3 serves as a condenser while the outdoor heat exchanger 5 serves as an evaporator. In the defrosting cycle (during the heating operation), the electromagnetic valve 10 is opened if occasion demands, and a part of the high temperature refrigerant discharged from the compressor 1 is guided to the outdoor heat exchanger 5 to increase the temperature of outdoor heat exchanger 5. With this operation, the temperature of the outdoor heat exchanger 5 is increased. When the defrosting operation does sufficiently work, (e.g. when the outside air temperature is extremely low) or when frosting progresses heavily, the progress of the frosting is suppressed by performing a reverse cycle defrosting operation which is indicated by an arrow of solid line.

Figure 11:
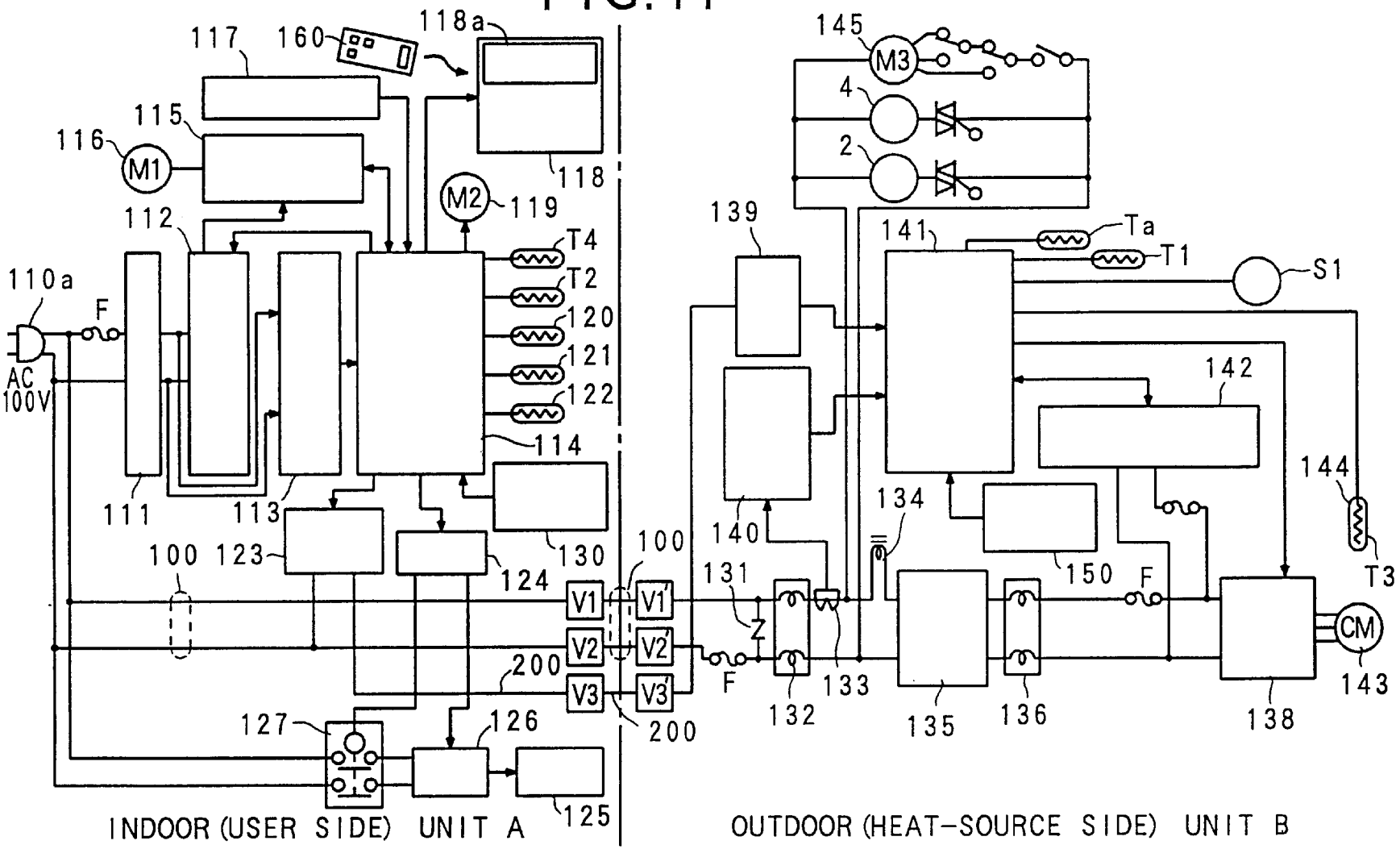
FIG. 11 is a control circuit diagram of the air conditioner of the present invention.

FIG. 11 shows a control circuit of the air conditioner of the present invention. The control circuit shown in FIG. 11 is divided into two control circuits with a one-dotted chain line at the center thereof. One circuit at the left side of FIG. 11 is a control circuit for an indoor side unit "A" (see FIG. 1), and the other circuit at the right side of FIG. 11 is a control circuit for an outdoor side unit "B". Both the circuits are connected to each other through power lines 100 and a control line 200.

The indoor side unit A is provided with a rectifier circuit 111, a power supply circuit 112 for motors, a power supply circuit 113 for control, a motor driving circuit 115, a switch board 117, a receiver circuit 118*a*, a display board 118, and a flap motor 119.

The rectifier circuit 111 rectifies and smooths an AC voltage (100 volts) supplied through a plug 110*a*. The power supply circuit 112 for motors adjusts a DC voltage which is supplied through the motor driving circuit 115 to a DC fan motor 6 to produce a voltage of 10 to 36 volts. The motor driving circuit 115 controls a supply timing of power supplied to a stator winding of the DC fan motor 116 in accordance with a signal transmitted from a microcomputer 114 to thereby control air to be blown out into a room to be air conditioned.

The power supply circuit 113 for control produces a DC voltage of 5 volts which is supplied to the microcomputer 114. On the other hand, the motor driving circuit 115 controls a switching timing of a power supply to the stator winding of the DC fan motor 116 in response to a signal supplied from the microcomputer 114, the signal being based on information of a rotational position of the DC fan motor 116. The switch board 117 is fixedly mounted on an operation panel of the indoor side unit A. The switch board 117 is provided with an on/off switch, a trial operation switch, etc. Switch states of these elements are taken in by the microcomputer 114 through a key scanning operation. The receiver circuit 18*a* receives a remote control signal (which is, for example, an on/off signal, a cooling/heating switching signal, a room temperature setting signal or the like) supplied from a wireless remote controller 60, then demodulated and transmitted to the microcomputer 114. The display board 8 dynamically turns on an LED on the basis of the signal from the microcomputer 114 to display an operation status of the air conditioner. On the other hand, the flap motor 119 is adjusted in the indoor heat exchanger 7, and functions so as to move a flap for altering a blowout direction of air which is blow out from the fan.

Further, the control circuit is further provided with a room temperature sensor 120 for measuring a room temperature, a heat exchanger temperature sensor 121 for measuring a temperature of the indoor heat exchanger, and a humidity sensor 122 for measuring a room humidity. The thus measured values in these sensors are subjected to an analog-to-digital (A/D) conversion and then supplied to the microcomputer 114. The microcomputer 114 carries out a calculation on the basis of these input information (take-in information) to transmit a control signal to the outdoor unit B through a serial circuit 123 and a terminal board V3 to set a driving capacity (power) of the four-way valve and the compressor 1. Both a triac 126 and a heater relay 127 are controlled by the microcomputer 114 through a driver 124 to stepwise control electric power to be supplied to a re-heating heater 125 used in a drying cycle (a state of the refrigerating cycle which is used for the cooling operation) of the air conditioner.

Reference numeral 130 represents an external ROM which stores therein specific data representing the type and characteristics of the air conditioner. These specific data are taken out from the external ROM immediately after the plug 110 is connected to a plug socket and power is supplied to cause the microcomputer 114 to rise up. The microcomputer 114 performs neither the input of commands from the wireless remote controller 160 nor its detecting operation of the state of ON/OFF switch or the trial driving switch (its operation will be described later) until the specific data has been completely taken out from the external ROM.

Next, the control circuit of the outdoor unit B will be described with reference to FIG. 11.

In the outdoor unit B, terminal boards V'1, V'2 and V'3 are connected with terminal boards V1, V2 and V3 of the indoor unit a, respectively. In FIG. 11, reference numeral 131 represents a varistor which is connected in parallel to the terminal boards V'1, V'2; reference numeral 132, a noise filter; reference numeral 134, a reactor; reference numeral 135, a voltage doubler rectifying circuit; and reference numeral 136, a noise filter.

Further, in FIG. 11, reference numeral 139 represents a serial circuit for dispersing the control signal supplied from the indoor unit through the terminal board V'3 from the power line, and the dispersed signal is transmitted to the microcomputer 141. Reference numeral 140 represents a current detector, and it serves to detect the current supplied to the outdoor unit B through current transformation (C.T.) and convert the current to a signal for the microcomputer 141. Reference numeral 142 represents a constant power circuit for producing a operating power of the microcomputer 141, reference numeral 138 represents a three phase inverter circuit for controlling the power supplied to the compressor on the basis of the control signal from the microcomputer 141 to adjust the driving capacity (power) of the compressor 1. The three-phase inverter circuit 138 has six power transistors which are connected in the form of a three-phase bridge. Reference numeral 143 represents a motor portion for driving the compressor 1 of the refrigerating cycle, and reference numeral 144 represents a discharge side temperature sensor for detecting the temperature of the refrigerant discharged from the compressor 1. Reference numeral 145 represents a fan motor which is disposed so as to blow out air to the outdoor heat exchanger and whose speed is controlled at three stages (levels). As described above, the four way changeover valve 3 and the electromagnetic valve 10 are designed to switch the refrigerant path of the refrigerating cycle.

Further, an outside temperature sensor for detecting the outside temperature is provided to the outdoor unit B so as to be adjacent to an air inlet port, and a heat exchanger temperature sensor 149 for detecting the temperature of the outdoor heat exchanger is secured to the outdoor heat exchanger. The detection values obtained by these temperature sensors 148 and 149 are subjected to the A/D conversion and supplied into the microcomputer 141.

Further, reference numeral 150 represents an external ROM which is similar in function to the external ROM 130 of the indoor unit A. Specific data on the outdoor unit B are the same as those of the external ROM 130, and stored in the ROM 150. Reference character F represents a fuse used in each control circuit of the outdoor unit B and the indoor unit A.

Each of the microcomputers 114, 141 (i.e., control devices) is designed so that a ROM in which programs are beforehand stored, a RAM in which reference data are stored and a CPU for operating the programs are contained in the same housing ("Intel 87Cl96MC (MCS-96 series") produced by Intel Corporation, or the like may be used).

Next, returning to FIG. 1, the construction of each refrigerant circuit will be described hereunder.

Each of the indoor heat exchanger 3 and the outdoor heat exchanger 5 is provided with fans 3*a*, 5*a* to perform a heat exchange operation between an outside air or indoor air and the refrigerant. Both the fans 3*a*, 5*a* are designed so that the respective air flow rates are variable, and for example, in response to a signal from the control unit 21, each of the fans 3*a*, 5*a* changes its air flow rate to any one of three stages (i.e., a low rate, a middle rate, and a high rate).

In the cooling cycle, the four-way valve 2 permits the refrigerant to flow in the direction of the arrows indicated by solid lines as shown in FIG. 1 while in the heating cycle it permits the refrigerant to flow in the direction of the arrows, indicated in dotted lines as shown in FIG. 1. By switching the four-way valve 2 in the manner as described above, the flow path of the refrigerant can be switched between the cooling cycle and the heating cycle.

Figure 2:
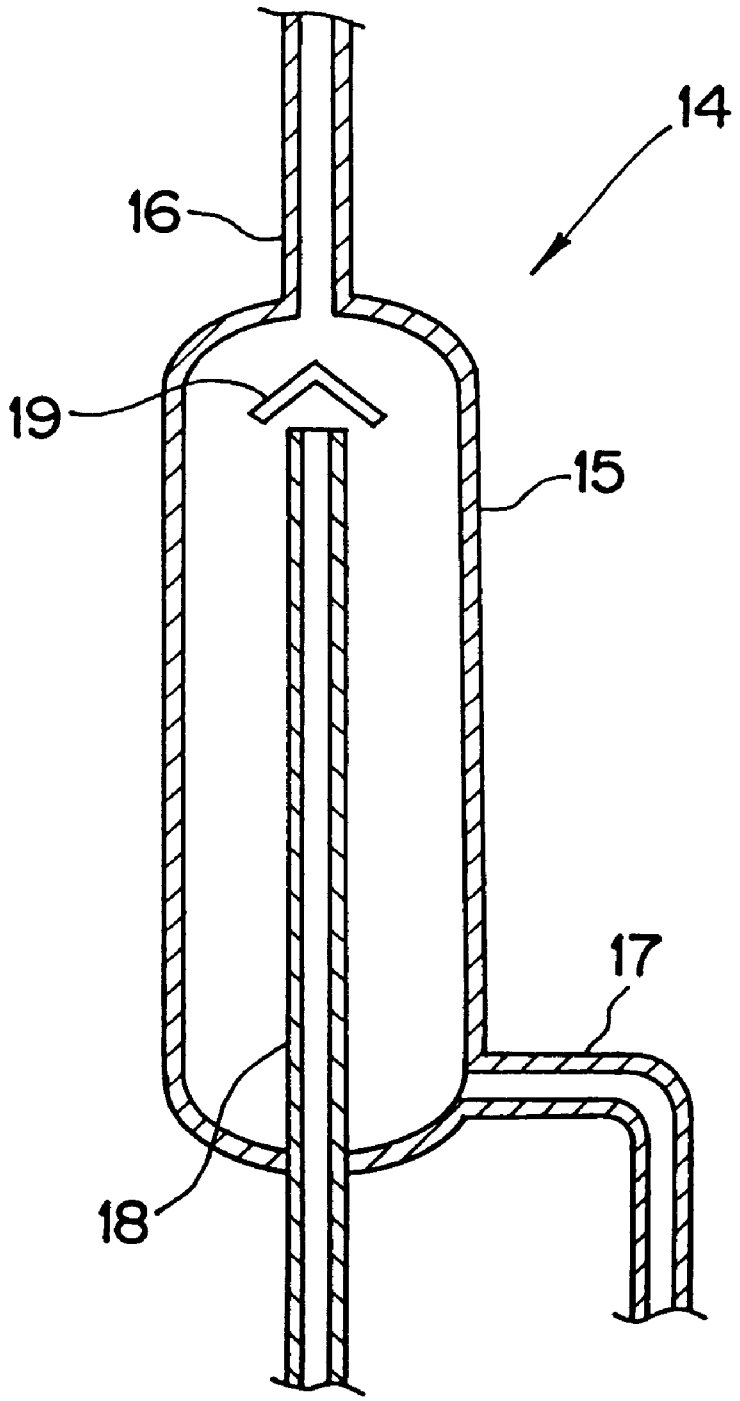
FIG. 2 is a longitudinal sectional view of a liquid reservoir used in the refrigerant circuit shown in FIG. 1.

A liquid reservoir 14 is disposed between the accumulator 6 and the four-way valve 2. As shown in FIG. 2, in the liquid reservoir 14, an upper portion of a reservoir body 15 is connected to a refrigerant inlet tube 16, and a lower portion of the body 15 is connected to a liquid outlet tube 17 for discharging liquefied stocked refrigerant from a bottom portion of the reservoir body 15. Further, a gas outlet tube 8 extending upwardly is connected to the reservoir 14, and the tube end of the gas outlet tube 18 is disposed to face the refrigerant inlet tube 6 through a gas-liquid separator plate 19. In the liquid reservoir 14 thus constructed, the gaseous refrigerant is guided into the accumulator 6 and the liquefied refrigerant stocked in the liquid reservoir 14 is discharged from the reservoir 14 through the liquid outlet tube 17.

The liquid outlet tube 17 is connected to a liquefied refrigerant return circuit 20 for returning the liquefied refrigerant to the accumulator 6 through a control valve 13 and a capillary tube 12.

The control valve 13 uses a step motor to adjust its opening degree. The step motor varies its rotational angle in accordance with a pulse signal from the control device 21, and its rotational angle is controlled to vary over 256 steps in response to the pulse signal from a control unit 21.

The control device 21 includes the microcomputers 114, 141 shown in FIG. 11 as described above, and it controls the entire refrigerant circuit. The accumulator 6 is substantially the same as that of the liquid reservoir 14, as will be seen also in FIG. 9 which illustrates a second embodiment of the present invention. Namely, as is clear from FIG. 9, the accumulator 6 is constructed by an accumulator body 29, a liquid outlet tube 3, and a gas-liquid separator plate 33, and the gaseous refrigerant stocked in the accumulator 6 is guided from the gas outlet tube 3 and then supplied to a suction side of the compressor 1 through the liquid outlet tube 31.

On the other hand, as described above, the refrigerant Circuit is provided with the temperature sensors (detectors) and the mixture ratio detector at proper positions to obtain the detection signals, and these detection signals are supplied to the control device 21. In this embodiment, temperature detectors or sensors T1, T2 are disposed to detect the respective refrigerant temperature at the outlet sides of the outdoor heat exchanger 5 and the indoor heat exchanger 3 respectively when each of the heat exchangers 3, 5 serves as a condenser.

Further, a temperature detector or sensor T3 for detecting the refrigerant temperature is disposed at the discharge side of the compressor 1, and another temperature detector or sensor T4 for detecting the refrigerant temperature is disposed at a low pressure side between the four-way valve 2 and the indoor heat exchanger 3. These detection signals are input to the control unit 21. In the refrigerating cycle of the present invention, by detecting the refrigerant temperature by means of these temperature detectors or sensors T1 and T2, abnormality of the mixture ratio of the mixture refrigerant and or abnormally high pressure in the refrigerant circuit are indirectly detected. Furthermore, the temperature detectors T1, T2 are disposed at both the outlet sides of these heat exchangers 3, 5 because they are matched to the detection of the refrigerant temperature for both the cooling and heating cycles.

Further, a mixture ratio detector W1 is disposed between the four-way valve 2 and the compressor 1 to directly detect a mixture ratio of the mixture refrigerant circulating through the refrigerant circuit, and supplies its detection signal to the control device 21. A temperature detector Ta for detecting the outside temperature is provided to the outdoor heat exchanger 5 side, and its detection signal is input to the control device 21.

Figure 3:
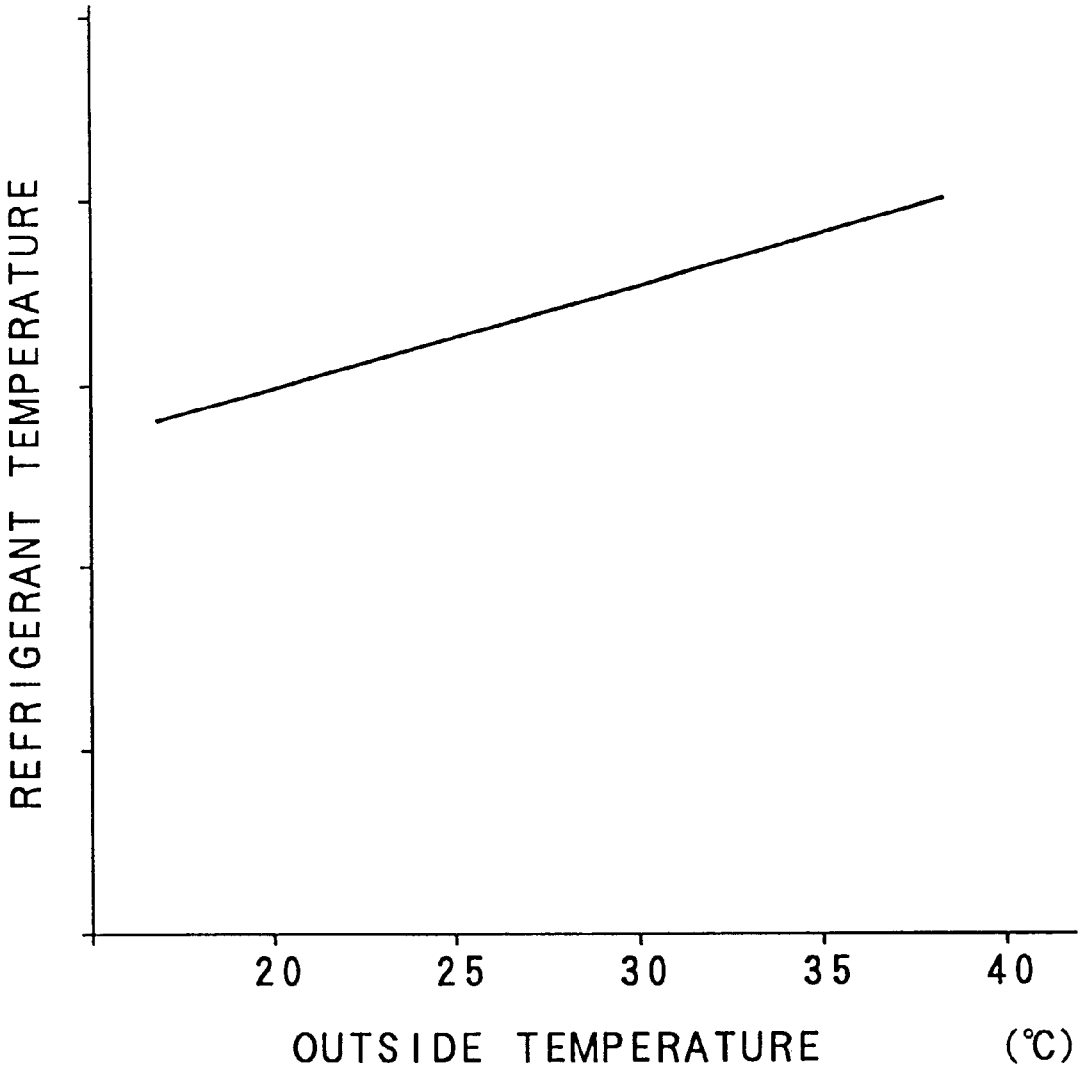
FIG. 3 is a graph illustrating the relationship between the temperature of the refrigerant and the outside air temperature.

Upon receiving these detection signals from the temperature sensors of detectors T1, T2, T3 and T4, the control device 21 makes a comparison between these values of the detection, signals and that of the outside air temperature detected by the outside air temperature sensor or detector Ta for calculation, and judges whether the refrigerant temperature is above a predetermined temperature. The reason why the refrigerant temperature is compared with the outside air temperature as described above is in that it is difficult to judge it only on the basis of the refrigerant temperature whether the refrigerant is excessively compressed (i.e., under excessively high pressure) because the refrigerant temperature is sensitive to the outside air temperature as is apparent from FIG. 3. When the refrigerant temperature is above the predetermined temperature, in order to prevent the refrigerant from being excessively compressed in the refrigerant circuit, a predetermined number of pulses to open the control valve 13 are output to increase the opening degree of the control valve 13. Likewise, upon receiving the detection signal from the mixture ratio detector W1, the control device 2 starts a necessary calculation processing on the detection signal, and supplies the control valve 3 with a single pulse to open the control valve 3 or a single pulse to close the control valve so that the mixing ratio of the high boiling-point refrigerant is constant, if necessary. The refrigerant mixing ratio detector includes a sound velocity measuring device for measuring the sound velocity of liquefied mixture refrigerant in the refrigerant circuit, a thermometer for measuring the temperature of the mixture refrigerant, and a pressure gauge for measuring the pressure of the mixture refrigerant, thereby surely measuring the concentration of the refrigerant. The measuring method of the mixing ratio of the mixture refrigerant is not limited to this method, and it may be made on the basis of variation of physical properties such as specific gravity, evaporation temperature or the like of the refrigerant. The mixing ratio detector is described in detail in Japanese Patent Application No. Hei-7-304298.

The mixing ratio detector contains a microcomputer in which data representing the relationship among velocity, temperature and pressure are programmed, and upon input of measurement values of velocity, temperature and pressure of the mixture refrigerant, it performs calculation processing to display the concentration (composition ratio) of the mixture refrigerant on a display unit and also supply this data to the microcomputer 141.

As for detection signals supplied from the temperature sensors or detectors T1, T2, T3, T4 and from the mixture ratio detector W1, all of theses detection signals are not necessarily used in the refrigerating cycle of the present invention. As will be clarified in the following description on the control process of the refrigerating cycle, a necessary one or two of the detection signals may be used to control the control valve 13.

A control method will be described according to the following control process.

In the refrigerant circuit shown in FIG. 1, in the cooling cycle, the four-way valve 2 shown in FIG. 1 is located at such an operational position as indicated by the solid line, and the refrigerant is circulated through the compressor 1, the outdoor heat exchanger 5, the pressure-reducing device 4, the indoor heat exchanger 3, the four way valve 2, the liquid reservoir 14 and the accumulator 6 in this order. On the other hand, during the heating cycle, the four-way valve 2 is located at such an operational position as indicated by a broken line of FIG. 1, and the refrigerant is circulated through the compressor 1, the indoor heat exchanger 3, the pressure-reducing device 4, the outdoor heat exchanger 5, the four-way valve 2, the liquid reservoir 14 and the accumulator 6 in this order.

In the liquid reservoir 14, the mixture refrigerant is separated into gas and liquid phases so that the liquefied mixture refrigerant is stocked at the bottom portion of the reservoir 14 while the gaseous mixture refrigerant is supplied to the accumulator 6 through the gas outlet tube 8. Consequently, only the liquefied mixture refrigerant is stocked in the liquid reservoir 14. Therefore, the refrigerant having a higher boiling-point is mainly stocked in the liquid reservoir 14 as the liquefied refrigerant because the low boiling-point refrigerant component tends to evaporate from the reservoir 14.

On the other hand, in the refrigerant circuit, since the higher boiling-point refrigerant component tends to be liquefied earlier than the lower boiling-point refrigerant component in the heat exchangers 3, 5, there is a case where the mixing ratio of the mixture refrigerant varies. The variation in the mixing ratio may often induce abnormally high pressure in the refrigerant circuit. Therefore, in order to prevent such abnormally elevated pressure in the circuit, the following control processing is performed.

In order to clarify the description, in the following description the reference characters representing the respective temperature sensors or detectors and the mixture ratio detector are also used to denote the detection signals supplied therefrom. For example, the reference character T1 also denotes a temperature value detected by the temperature sensor or detector T1.

Control Process 1

Figure 4:
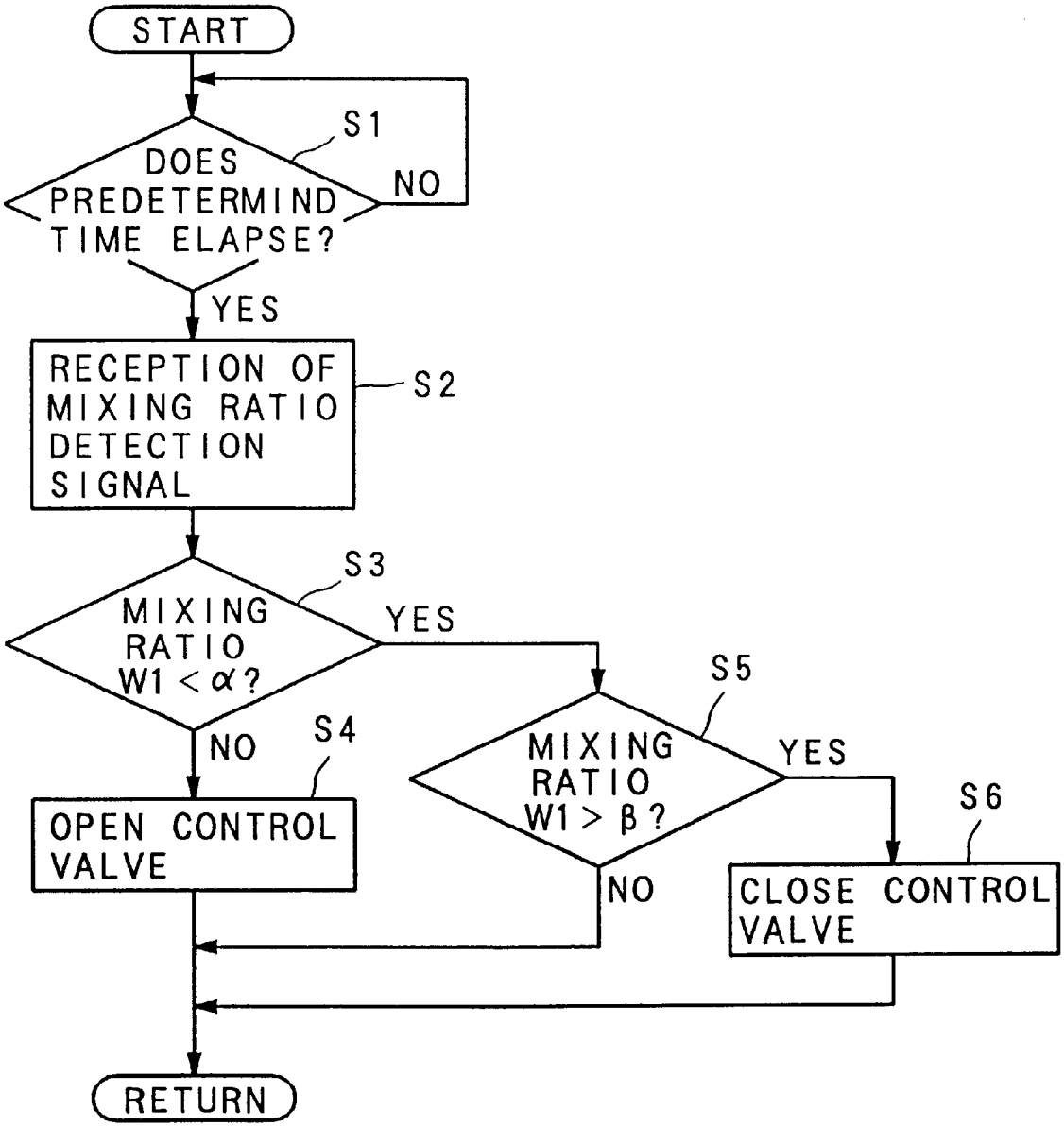
FIG. 4 is a flowchart graphically representing a control process according to a first control process in the air conditioner of the present invention.

As shown in FIG. 4, when the control process starts, the control device 21 judges in a step S1 whether a predetermined period of time elapses. If the predetermined period of time is judged to have elapsed, the process goes to step S2 to start reception of a mixing ratio detection signal. The predetermined period of time as mentioned above is a time required to stabilize the state of the refrigerant in the refrigerant circuit, and it is set to 30 seconds, 1 minute or the like.

In the step S2, the detection signal from the mixing ratio detector W1 is received to measure the mixing ratio of the refrigerant, and then the process goes to step S3.

In the step S3, it is judged whether or not the thus determined mixing ratio of the high boiling-point refrigerant component is lower than a predetermined value $\alpha$. If the mixing ratio is lower than the predetermined value $\alpha$, the process goes to step S4 to output a single valve opening pulse to the control valve 13 so that the control valve 13 is opened by a prescribed opening degree in accordance with the measurement value. In the step S4, by opening the control valve 13, the supply amount of the high boiling-point refrigerant stocked in the liquid reservoir 14 which is supplied through the capillary 12 and the accumulator 6 to the suction port (low pressure side) of the compressor 1 is increased, whereby the mixing ratio of the mixture refrigerant circulating through the refrigerant circuit is kept to a predetermined value. Consequently, the abnormally high pressure, i.e., the abnormally elevated pressure of the refrigerant due to the variation of the mixing ratio of the refrigerant can be prevented. Furthermore, the optimum mixing ratio of the mixture refrigerant can be kept and the high driving efficiency and the stability of the refrigerant can be maintained. Thereafter, the process goes to the return step.

In the step S3, if the mixing ratio W1 detected by the mixing ratio detector W1 is not lower than the predetermined value $\alpha$, the process goes to step S5 to judge whether the mixing ratio W1 is higher than a predetermined value $\beta$. If the mixing ratio W1 is higher than the predetermined value $\beta$, the process goes to step S6 to output a single valve closing pulse to the control unit 21 to close the control valve 13. If the mixing ratio W1 is not higher than the predetermined value $\beta$, the process goes to the return step and thus to the start step shown in FIG. 4. The predetermined values $\alpha$ and $\beta$ are set as a permissible range to prevent chattering of the control valve 13. In order to prevent occurrence of such chattering, the mixing ratio detector W1 may be provided with a predetermined insensitive area.

Control Process 2

Figure 5:
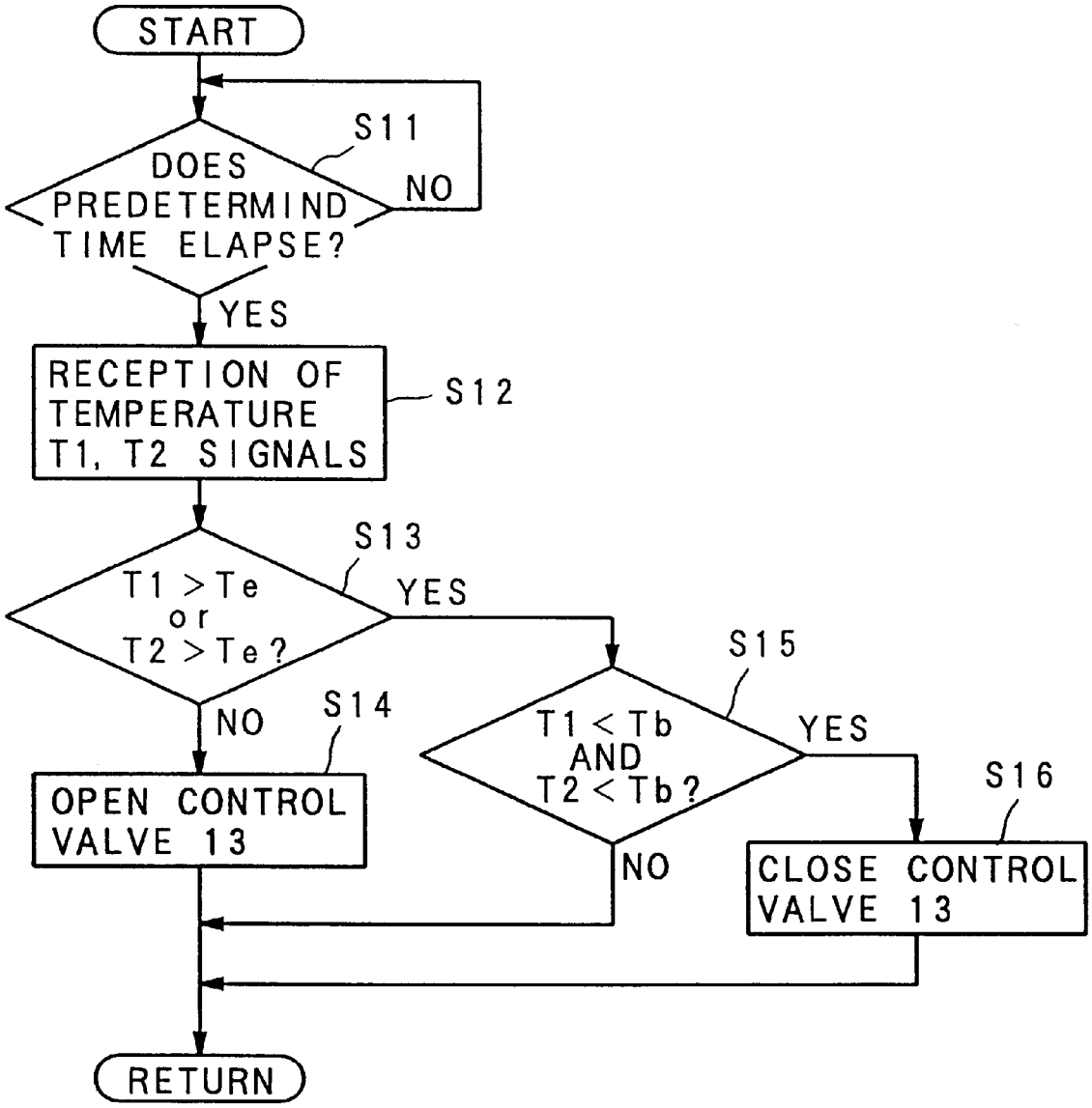
FIG. 5 is a flowchart graphically representing a control process according to a second control process in the air conditioner of the present invention.

In a flowchart shown in FIG. 5, when the control process starts, in a step S11 it is judged whether a predetermined period of time elapses. If the predetermined period of time has elapsed, the process goes to step S12 to start the reception of the mixing ratio detection signal. In the step S12, the reception of the detection signals T1. T2 which represent the detected temperatures T1, T2 of the outlet sides of the heat exchangers 5, 3 serving as the condensers) is started, and then the process goes to step S13.

On the other hand, in the step S13, if the detection temperature T1 or T2 is higher than a predetermined temperature Te, it is judged that the mixing ratio of the refrigerant circulating through the refrigerant circuit exceeds the predetermined value, and thus the process goes to step S14.

In the step S14, the control valve 13 is opened by a predetermined opening degree (a predetermined number of valve opening pulses are supplied) to return the high boiling-point refrigerant stocked in the liquid reservoir 14 to the accumulator 6 like the control process. As described above, the opening/closing ratio of the control valve 13 is corrected on the basis of the mixing ratio of the refrigerant which is estimated through the temperature of the outlet side of the condenser, whereby the mixing ratio of the mixture refrigerant circulating through the refrigerant circuit can be simply and surely controlled. Thereafter, the process goes to the return step.

On the other hand, in the step S13, if the detected temperature T1 or T2 is not higher than the predetermined temperature Te, the process goes to step S15 to judge whether the detected temperatures T1 and T2 are lower than a predetermined temperature Tb.

In the step S15, if the detected temperatures T1 and T2 are lower than the predetermined temperature Tb, the process goes to step S16 to close the control valve like the control process. If the detected temperatures T1, T2 are not lower than the predetermined temperature Tb, the process goes to the return step.

Control Process 3

Figure 6:
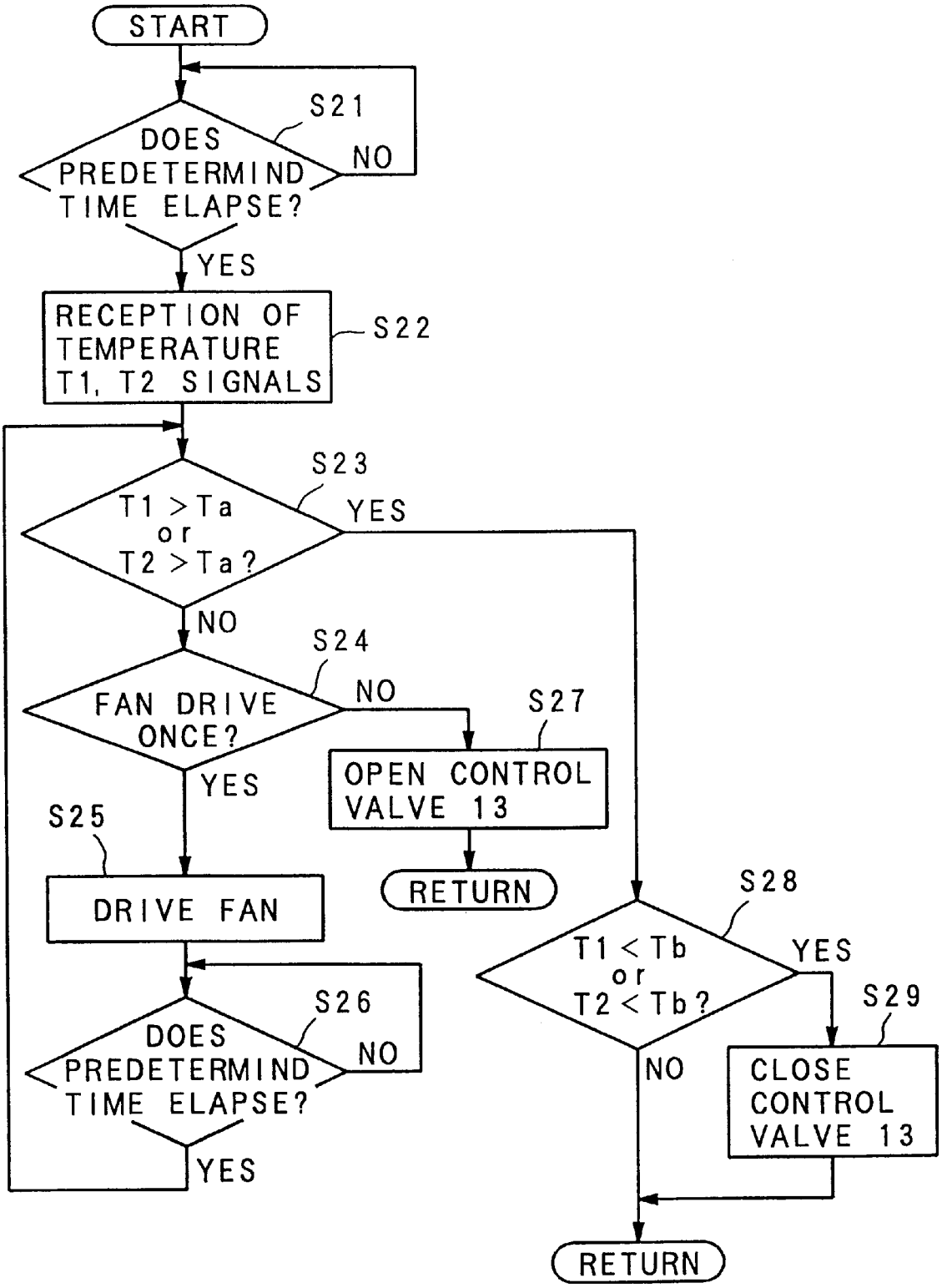
FIG. 6 is a flowchart graphically representing a control process according to a third control process in the air conditioner of the present invention.

In the control process 3 shown in FIG. 6, like the control processes 1 and 2, the abnormally high pressure in the refrigerant circuit is judged from the steps S22 and S23 on the basis of the judgment as to whether the value of the detection signal in the temperature detector T1 or T2 is higher than the predetermined temperature Ta. If the abnormally high pressure in the refrigerant circuit is judged, the process goes to step S24 through time-up judgment step.

In the step S24, it is judged whether the fan 5*a* (or the fan 3*a* during the heating cycle) of the condenser 5 (which is the outdoor heat exchanger 5 during the cooling cycle, and the indoor heat exchanger 3 during the heating cycle) is controlled to be driven once at high speed (flag F=1). If they are still not driven, the flag F is set to 1 and then the process goes to step S25 to drive the fan 5*a* at high speed.

In the step S25, by driving the fan 5*a* of the condenser 5 at high speed, the cooling efficiency of the condenser 5 is improved, and liquefaction of the refrigerant is promoted to thereby suppress the high pressure of the refrigerant circuit.

For example, in a case where the fan 5*a* is driven at the three stages of low, middle and high speeds, the fan 5*a*, if currently operating at the low speed, is driven at the middle or high speed. When the indoor heat exchanger 3 serves as the condenser during the heating cycle, the fan 3*a* is driven at the low or middle speed when the fan 3*a* is still not driven.

In step S26, a timer is started and then it is judged whether a predetermined period of time elapses after the driving control of the fan. If the predetermined period of time elapsed, the process returns to the step S23 to judge whether the value of the detection signal in the temperature detector T1 or T2 is higher than the predetermined temperature Ta again. That is, it is judged whether the abnormally high pressure of the refrigerant circuit has been reduced under the fan driving control of the step S25. When it is judged that the abnormally high pressure still remains in the refrigerant circuit, the process goes to step S24. In this case, if the fan has been driven once at high speed (flag F=1), the process goes to step S27 to control the control valve 3 to be opened like the control processes 1 and 2 and then drives the fan 5*a* at a normal speed (S25').

As described above, in the refrigerating cycle of the present invention, the two stage control operation is conducted on the fans 3*a* and 5*a* and the control valve 13 for the following reason. The increase of the refrigerant temperature is not necessarily based on the variation in the mixing ratio of the refrigerant, and thus some increase of the refrigerant temperature can be suppressed by the fans 3*a*, 5*a* of the condenser. Further, when the fans 3*a*, 5*a* fail to decrease the refrigerant temperature, the high pressure in the refrigerant circuit is controlled.

In the step S23, if the value of the detection signal T1 or T2 of the temperature detector T1 or T2 is not larger than the predetermined temperature Ta, the process goes to steps S28 and S29 to perform the same control as the steps S15 and S16 of the control process 2.

Control Process 4

Figure 7:
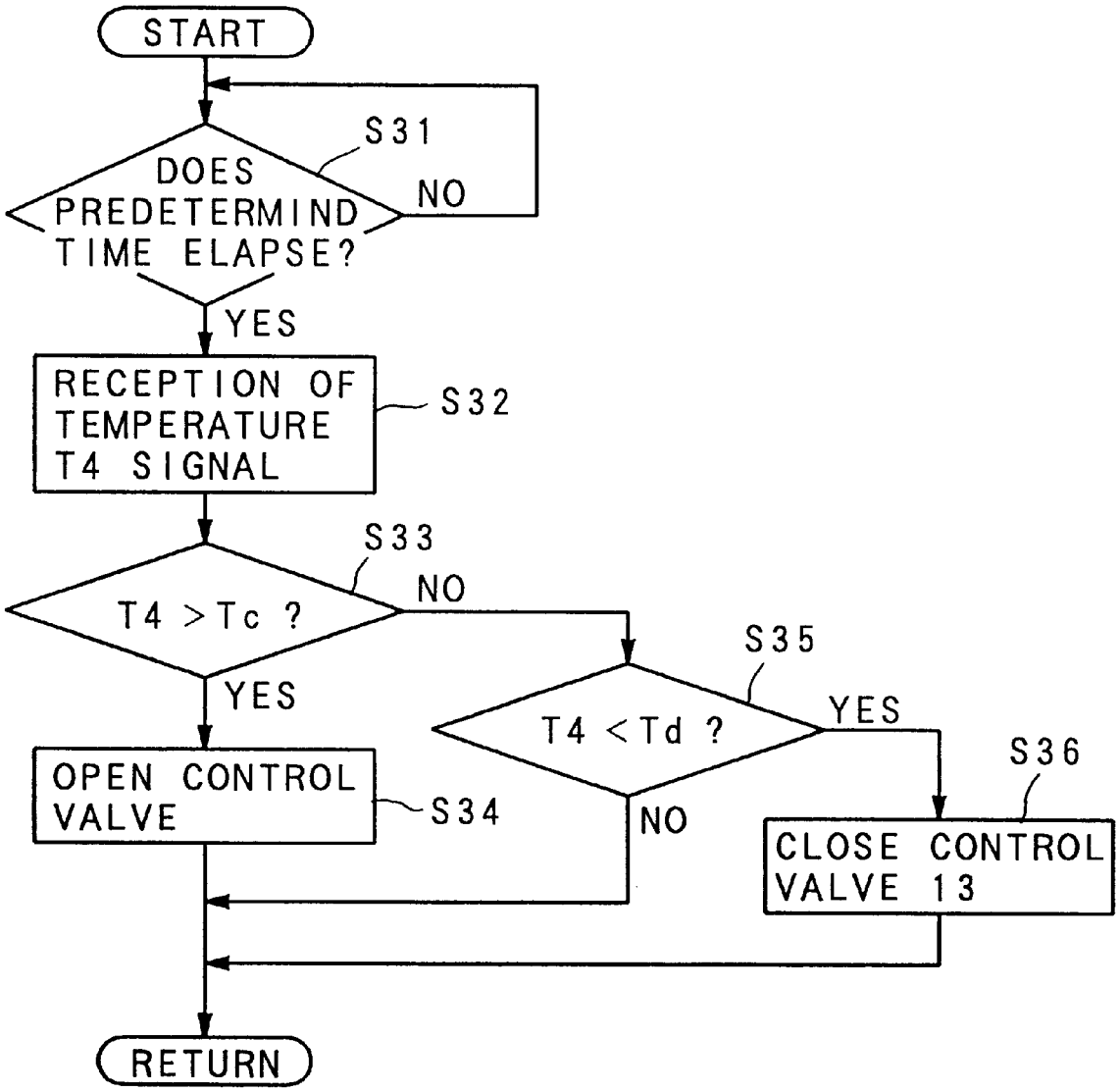
FIG. 7 is a flowchart graphically representing a control process according to a fourth control process in the air conditioner of the present invention.
Figure 8:
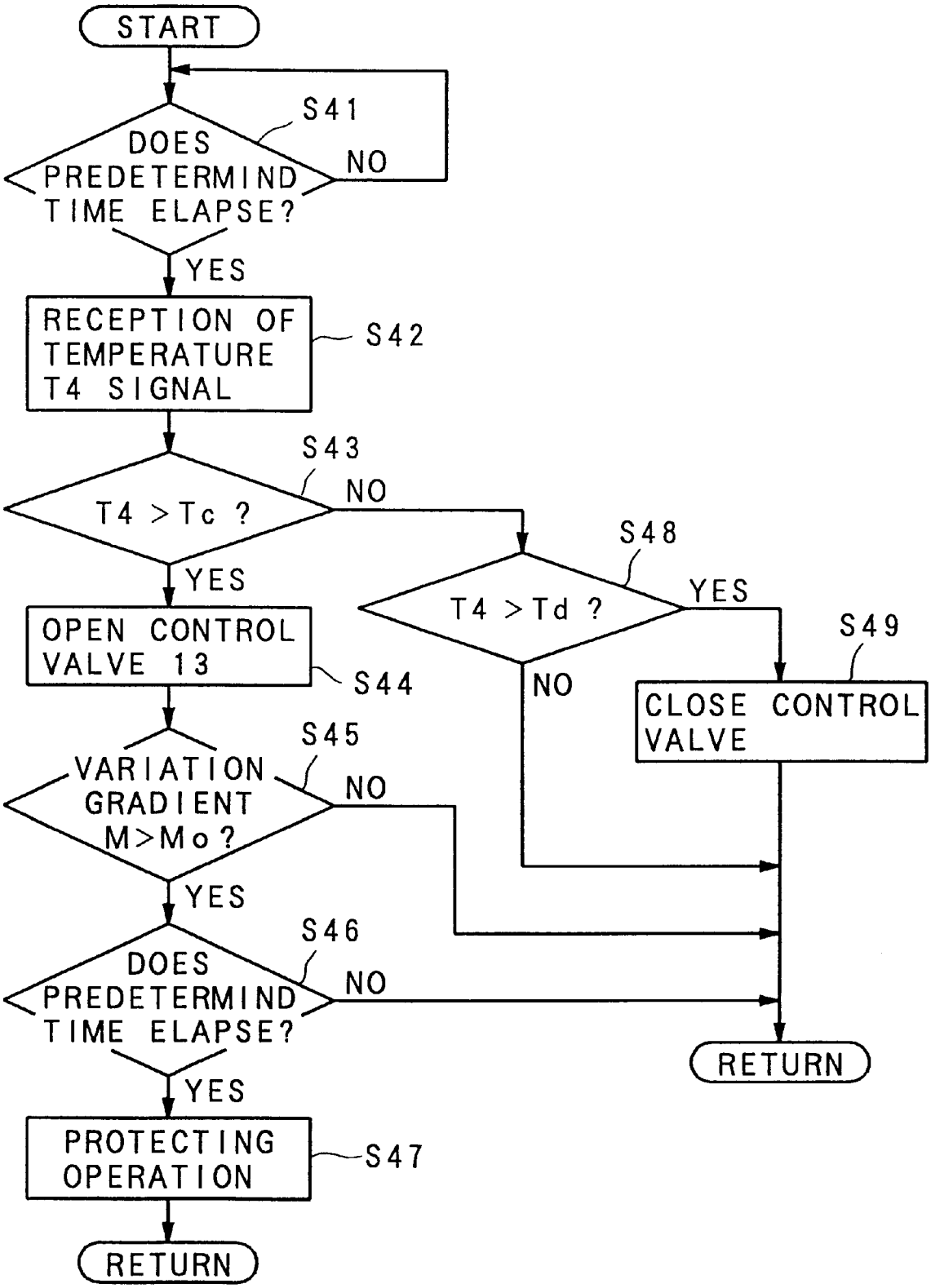
FIG. 8 is a flowchart graphically representing a control process according to a fifth control process in the air conditioner of the present invention.

As shown in FIG. 7, the control process 4 is substantially similar to the control process 2 shown in FIG. 5, and it is different from the control process 2 in that the temperature of the temperature detector T4 at the low pressure side of the refrigerant circuit is detected instead of the temperature detectors T1, T2. That is, in a step S32, a detected temperature signal T4 from the temperature detector T4 disposed at the low-pressure side of the refrigerant is received, and in step S33 it is judged whether the temperature T4 is lower than a predetermined value Tc. If in step S33 it is judged that T4 is lower than Tc, the process goes to step S34 to open the control valve 13 and return the high boiling-point refrigerant component stocked in the liquid reservoir 14 to the low pressure side of the compressor. As described above, the mixing ratio of the refrigerant is estimated on the basis of the temperature at the low pressure side of the refrigerant circuit, and the opening/closing ratio of the control valve 13 is controlled on the basis of the thus estimated mixing ratio of the refrigerant, whereby the abnormally high pressure can be prevented from being produced in the refrigerant circuit through a simple temperature measurement. If T4 is higher than a predetermined value Td in step S33, the process goes to step S36 close the control valve 13.

Control Process 5

In the control process 5, the abnormally high pressure of the refrigerant circuit is judged on the basis of the detection temperature T4 to control the opening and closing operation of the control valve 13 like the control process 4 shown in FIG. 7.

The control process 5 is characterized by a series of steps S45, S46 and S47. Namely, after the control valve 13 is opened in the step S44, in step S45 a variation gradient M of the opening degree of the control valve 13 is detected, and then it is judged whether the variation gradient M (a period at which the valve-opening pulse is output) exceeds a predetermined fixed value Mo.

In the step S46 and step S46', it is judged whether the variation gradient M continues to exceed the fixed value Mo for a predetermined time. If the variation gradient M continues to exceed Mo for the predetermined time, for example, 30 seconds, the process goes to step S47 to perform a protection operation. The flag G indicates whether the condition M>Mo has continued for a time period that exceeds a predetermined time. In other words, when the predetermined period of time has elapsed while the variation gradient M of the opening degree of the control valve 13 (the period at which the valve opening pulse is output) exceeds the fixed value Mo, it is estimated that refrigerant leaks from the refrigerant circuit. Consequently, in this case, the control device 21 performs the protection operation to stop the operation of the compressor for example, and thus stop the operation of the refrigerant circuit for safety. In addition, the control device 21 gives an alarm for inspection of the refrigerant circuit at the same time. The protection operation may be performed by putting the control valve 13 in a fully opened condition. This protecting operation may be added just prior to the return step of each of FIGS. 4, 5 and 7, and along the return loop of FIG. 6, if occasion demands.

Here, the opening and closing operation of the control valve 13 will be described in association with the entire operation of the air conditioner.

In the heating cycle, when the outside air temperature is low, the operation is performed while the control valve 13 is fully opened for a predetermined period of time in order to perform a high-efficiency operation. In the defrosting cycle, the operation is performed while the control valve 1 is fully closed in order to shorten the defrosting time. Furthermore, when the refrigerating cycle is started after it is stopped for a long time, the operation is carried out while the control valve 1 is fully closed for a predetermined time in order to improve the refrigerating cycle in its starting characteristic.

Next, a second embodiment according to the present invention will be described with reference to FIG. 9.

The second embodiment of the present invention differs from the first embodiment of the present invention of FIG. 1 in that a recirculating mechanism 27 having no control valve 13 and no capillary 12 is provided in the liquefied refrigerant return circuit 20.

Figure 9:
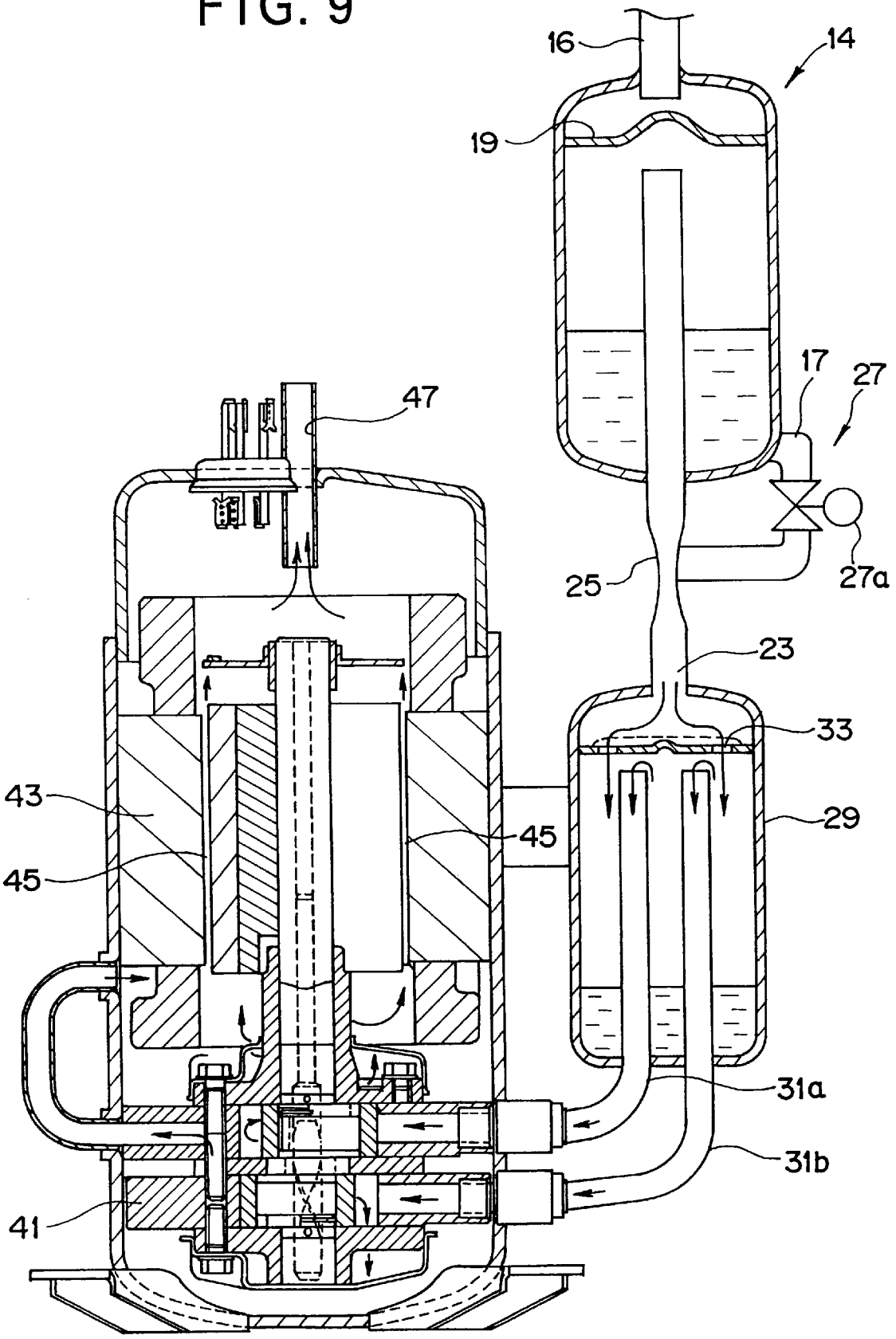
FIG. 9 is a cross-sectional view of an essential part of a second embodiment of the present invention.

In the recirculating mechanism 27, as shown in FIG. 9, an inlet tube 23 of the accumulator 6 is connected with a gas outlet tube 18 of the liquid reservoir 14. The inlet tube 23 is formed with a pressure reducing portion 25 which is designed to be necked and serves as an adjustment mechanism. This pressure-reducing portion 25 of the inlet tube 23 is designed to be necked like a venturi-tube type shape having a small-diameter portion, or it may be designed to have an orifice therein.

In the pressure-reducing portion 25 serving as the adjustment mechanism, a negative pressure to be produced in the mechanism is set so that a predetermined amount of the liquefied refrigerant stocked in the liquid reservoir 14 is returned to the refrigerant circuit using no power and no driving mechanism. Namely, by setting the negative pressure in the pressure-reducing portion 25 of the inlet tube 23 to an appropriate value (a value which is beforehand obtained through an experiment), it is possible to keep constant the mixing ratio of a specific refrigerant component of the mixture refrigerant which circulates through the refrigerant circuit.

According to the second embodiment of the present invention, shown in FIG. 9, the mixing ratio of the mixture refrigerant in the refrigerant circuit (i.e., the mixing ratio of the specific refrigerant component) is kept constant, so that the abnormal increase of the pressure of the refrigerant due to the variation in the mixing ratio can be prevented from occurring in the refrigerant circuit. Further, in the refrigerating cycle of the present invention, an initial proper value of the mixing ratio of the refrigerant is kept constant in the refrigerant circuit, and thus it is possible for the refrigerating cycle to operate at its highest operational efficiency and to keep safety of the refrigerant.

Furthermore, in the second embodiment of the present invention, in contrast with the first embodiment shown in FIG. 1, any of the mixing ratio detector, the temperature sensors or detectors and the control device which performs the control operation on the basis of the detection signals from these detectors is not required, and thus the construction of the second embodiment can be simplified.

Like the liquid reservoir 14, the accumulator 6 comprises an accumulator body 29, a liquid outlet tube 31, and a gas-liquid separator plate 33, and it supplies the gaseous refrigerant discharged from the gas outlet tube 31 to a suction side of the compressor 1. The refrigerant thus supplied to the compressor is compressed in a compression portion 4, and then passes through a clearance 45 of a motor portion 43 into an outlet opening 47 through which the refrigerant is discharged to the refrigerant circuit. The present invention is not limited to the above embodiments, and various modifications may be made without departing from the subject matter of the present invention. For example, in the refrigerant circuit shown in FIG. 1, it is also possible to use only one of the temperature detectors T1, T2, T3, T4 and the mixture ratio detector W1. In other words, it is also possible to control the control valve 13 on the basis of any one of the detection signals.

Figure 10:
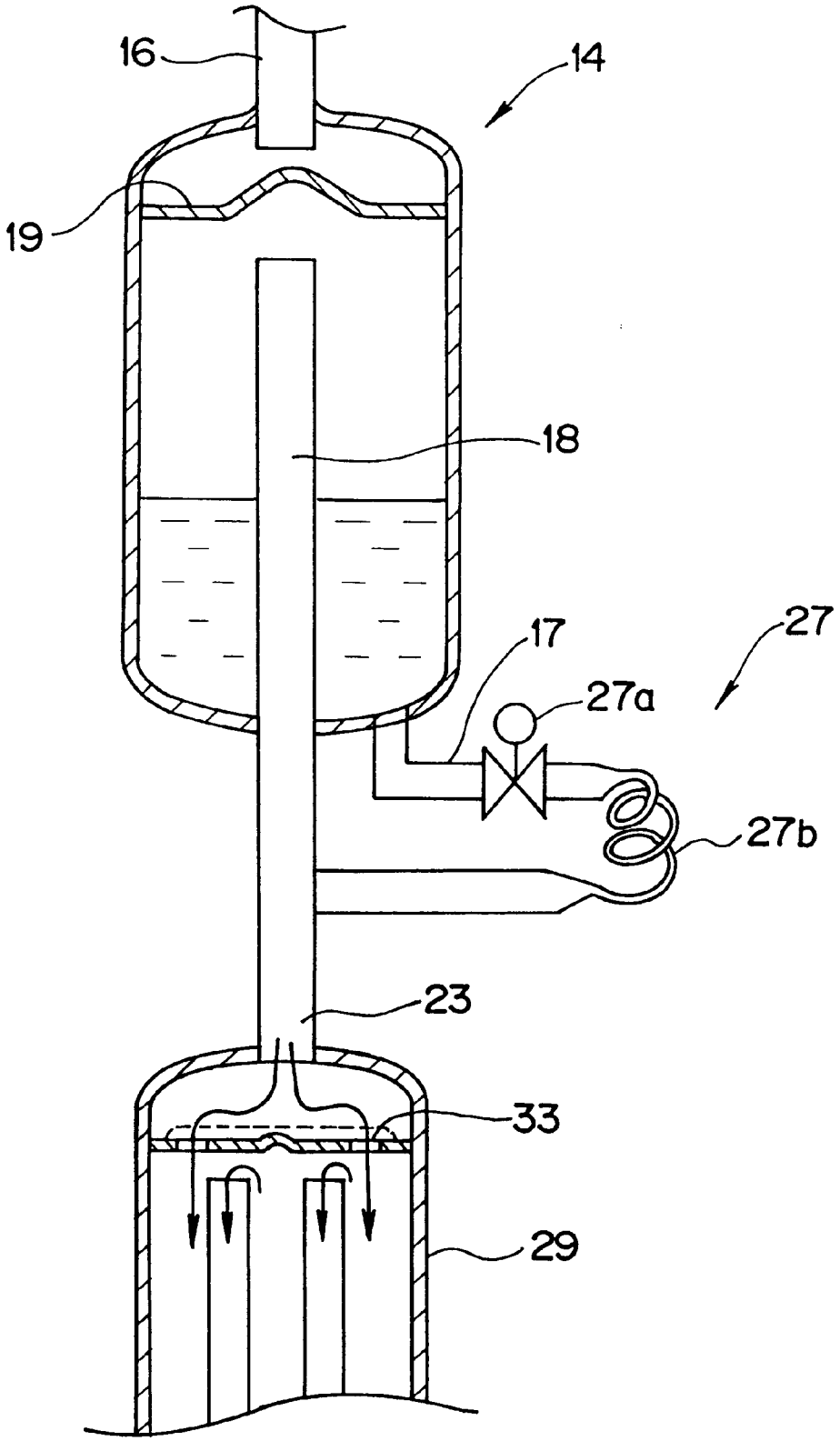
FIG. 10 is a cross-sectional view showing a third embodiment of the present invention.

Furthermore, the capillary tube 27*b* may be interposed in the recirculating mechanism 27 as shown in FIG. 10 to impose a load. In this case, counterflow of the liquid in the recirculating mechanism 27 can be prevented.

The present invention relates to the refrigerating cycle, and its applied field is not limited to an air conditioner. In other words, the present invention is applicable to any equipment insofar as the equipment uses a refrigerating cycle. For example, the present invention may be applied to a refrigerator, a large-scale air conditioner, a prefabricated refrigerator, etc.

What is claimed is:

1. A refrigerating cycle in which a refrigerant mixture consisting of plural refrigerants having different characteristics are circulated and which includes a refrigerant circuit comprising at least a compressor having a low-pressure side, a condenser, an expansion device and an evaporator, the refrigerant mixture being circulated through an operation of the compressor, comprising:

detection means for detecting a physical status of the refrigerant mixture circulating in said refrigerant circuit, the physical status including a condensation temperature of the mixture refrigerant;

stock means, disposed in said refrigerant circuit, for stocking liquefied refrigerant in said refrigerant circuit;

refrigerant supply means for supplying the liquefied refrigerant stocked in said stock means to a predetermined place in said refrigerant circuit at which the refrigerant mixture circulating in said refrigerant circuit is on the low-pressure side of the compressor;

flow amount adjusting means for adjusting the amount of the liquefied refrigerant passing through said refrigerant supply means;

control means for controlling said flow amount adjusting means on the basis of the physical status of the refrigerant mixture which is detected by said detecting means, wherein the flow amount of the liquefied refrigerant passing through said refrigerant supply means is controlled on the basis of the physical status detected by said detection means so that the physical status of the refrigerant mixture circulating is said refrigerant circuit is within a predetermined range; and a fan for blowing out air to said condenser, wherein said control means controls said flow amount adjusting means so that the amount of the liquefied refrigerant flowing in said refrigerant supply means and the air flow amount of said fan increase when the condensation temperature detected by said detection means exceeds a predetermined temperature.

2. The refrigerating cycle as claimed in claim 1, wherein said flow amount adjusting means has a refrigerant flow path through which the refrigerant mixture flows, and expansion means for narrowing said refrigerant flow path to expand the refrigerant mixture, thereby adjusting the refrigerant flow amount.

3. The refrigerating cycle as claimed in claim 2, wherein the physical quantity of the refrigerant mixture which is detected by said detection means includes an occupation ratio of a specific refrigerant in the refrigerant mixture.

4. The refrigerating cycle as claimed in claim 1, wherein said control means controls and opening and closing operation of said flow amount adjusting means on the basis of the condensation temperature which is detected by said detection means.

5. The refrigerating cycle as claimed in claim 1, wherein the physical quantity of the refrigerant mixture detected by said detection means includes the temperature of the refrigerant mixture, which exists in a pressure-reduced state in said refrigerant circuit.

6. The refrigerating cycle as claimed in claim 5, wherein said control means controls said flow amount adjusting means so that the amount of the liquefied refrigerant flowing in said refrigerant supply means increases when the temperature of the refrigerant mixture detected by said detection means is lower than a predetermined temperature.

7. A refrigerating cycle in which a refrigerant mixture consisting of plural refrigerants having different characteristics are circulated and which includes a refrigerant circuit comprising at least a compressor having a low-pressure side, a condenser, an expansion device and an evaporator, the refrigerant mixture being circulated through an operation of the compressor, comprising:

detection means for detecting a physical status of the refrigerant mixture circulating in said refrigerant circuit;

stock means, disposed in said refrigerant circuit, for stocking liquefied refrigerant in said refrigerant circuit;

refrigerant supply means for supplying the liquefied refrigerant stocked in said stock means to a predetermined place in said refrigerant circuit at which the refrigerant mixture circulating in said refrigerant circuit is on the low-pressure side of the compressor;

flow amount adjusting means for adjusting the amount of the liquefied refrigerant passing through said refrigerant supply means;

control means for controlling said flow amount adjusting means on the basis of the physical status of the refrigerant mixture which is detected by said detecting means, wherein the flow amount of the liquefied refrigerant passing through said refrigerant supply means is controlled on the basis of the physical status detected by said detection means so that the physical status of the refrigerant mixture circulating is said refrigerant circuit is within a predetermined range; and protection means for performing a protecting operation when a variation gradient of the flow amount of the refrigerant mixture flowing in said refrigerant supply means by said flow amount adjusting means continues to exceed a predetermined value for a predetermined time or more.

8. The refrigerating cycle as claimed in claim 7, wherein the protecting operation of said protection means is to stop the operation of said compressor.

9. The refrigerating cycle as claimed in claim 8, wherein the protecting operation of said protection means is to increase the amount of the liquefied refrigerant flowing in said refrigerant supply means.

10. The refrigerating cycle as claimed in claim 7, wherein said flow amount adjusting means has a refrigerant flow path through which the refrigerant mixture flows, and expansion means for narrowing said refrigerant flow path to expand the refrigerant mixture, thereby adjusting the refrigerant flow.

11. The refrigerating cycle as claimed in claim 10, wherein the physical quantity of the refrigerant mixture which is detected by said detection means includes an occupation ratio of a specific refrigerant in the refrigerant mixture.

12. The refrigerating cycle as claimed in claim 7, wherein the physical quantity of the refrigerant mixture detected by said detection means includes the temperature of the refrigerant mixture, which exists in a pressure-reduced state in said refrigerant circuit.

13. The refrigerating cycle as claimed in claim 12, wherein said control means controls said flow amount adjusting means so that the amount of the liquefied refrigerant flowing in said refrigerant supply means increases when the temperature of the refrigerant mixture detected by said detection means is lower than a predetermined temperature.

14. A refrigerating cycle in which a refrigerant mixture consisting of plural refrigerants having different characteristics are circulated and which includes a refrigerant circuit comprising at least a compressor having a low-pressure side, a condenser, an expansion device and an evaporator, the refrigerant mixture being circulated through an operation of the compressor, comprising:

detection means for detecting a physical status of the refrigerant mixture circulating in said refrigerant circuit;

stock means, disposed in said refrigerant circuit, for stocking liquefied refrigerant in said refrigerant circuit;

refrigerant supply means for supplying the liquefied refrigerant stocked in said stock means to a predetermined place in said refrigerant circuit at which the refrigerant mixture circulating in said refrigerant circuit is on the low-pressure side of the compressor;

flow amount adjusting means for adjusting the amount of the liquefied refrigerant passing through said refrigerant supply means;

control means for controlling said flow amount adjusting means on the basis of the physical status of the refrigerant mixture which is detected by said detecting means, wherein the flow amount of the liquefied refrigerant passing through said refrigerant supply means is controlled on the basis of the physical status detected by said detection means so that the physical status of the refrigerant mixture circulating is said refrigerant circuit is within a predetermined range; and a gas-liquid separating means provided to a vacuum side of said compressor in said refrigeration circuit, wherein said refrigerant supply means supplies the liquefied refrigerant to an inlet port of said gas-liquid separating means through said flow amount adjusting means, wherein the refrigerant mixture circulating in said refrigerating cycle is formed of a least R-32 (difluoromethane) and R-125 (pentafluoro-ethane).

15. The refrigerating cycle as claimed in claim 14, wherein said refrigerant recirculating means includes a venturi tube.

16. The refrigerating cycle as claimed in claim 14, wherein said refrigerant recirculating means includes a tube having a constricted portion on either side of an orifice.

17. The refrigerating cycle as claimed in claim 14, wherein said refrigerant recirculating means includes a pressure reducing portion.

18. The refrigerating cycle as claimed in claim 14, wherein the physical quantity of the refrigerant mixture which is detected by said detection means includes one of an occupation ratio of a specific refrigerant in the refrigerant mixture and the temperature of the refrigerant mixture which exists in a pressure-reduced state in said refrigerant circuit.

* * * * *